US011725457B2

(12) United States Patent
Watson et al.

(10) Patent No.: US 11,725,457 B2
(45) Date of Patent: Aug. 15, 2023

(54) DRILLING APPARATUS AND RELATED METHOD

(71) Applicant: Watson, Incorporated, Fort Worth, TX (US)

(72) Inventors: Douglas A. Watson, Aledo, TX (US); Joshua N. Keck, Aledo, TX (US)

(73) Assignee: Watson, Incorporated, Fort Worth, TX (US)

( * ) Notice: Subject to any disclaimer, the term of this patent is extended or adjusted under 35 U.S.C. 154(b) by 0 days.

(21) Appl. No.: 17/864,509

(22) Filed: Jul. 14, 2022

(65) Prior Publication Data

US 2022/0349258 A1 Nov. 3, 2022

Related U.S. Application Data

(63) Continuation of application No. 17/196,454, filed on Mar. 9, 2021, now Pat. No. 11,414,929.

(60) Provisional application No. 62/987,076, filed on Mar. 9, 2020.

(51) Int. Cl.
*E21B 7/02* (2006.01)

(52) U.S. Cl.
CPC ..... *E21B 7/023* (2013.01); *E21B 7/021* (2013.01); *E21B 7/027* (2013.01)

(58) Field of Classification Search
CPC . E21B 7/023; E21B 7/025; E21B 7/02; E02D 7/16; E02D 13/10; E02D 7/00; B66C 2700/0357; B66C 23/26
See application file for complete search history.

(56) References Cited

U.S. PATENT DOCUMENTS

| | | | | | |
|---|---|---|---|---|---|
| 2,271,577 | A * | 2/1942 | Woolslayer | E21B 7/023 | 33/19.3 |
| 2,589,080 | A | 3/1952 | Heinish | | |
| 2,904,310 | A | 9/1959 | Leonard | | |
| 3,109,523 | A * | 11/1963 | Moller | B66C 23/36 | 254/335 |
| 3,385,014 | A * | 5/1968 | Haug | E02D 7/16 | 173/90 |
| 3,754,604 | A * | 8/1973 | Inaba | E02D 7/16 | 173/28 |
| 4,099,579 | A | 7/1978 | Stormon | | |
| 4,126,193 | A * | 11/1978 | Brown | E21B 21/02 | 175/320 |
| 4,368,602 | A | 1/1983 | Manten | | |
| 4,785,892 | A * | 11/1988 | Luen | E02D 9/02 | 173/39 |
| 5,107,940 | A * | 4/1992 | Berry | E21B 7/023 | 175/122 |
| 5,551,519 | A * | 9/1996 | Pach | E02D 7/02 | 173/28 |
| 6,405,492 | B1 | 6/2002 | Scheid et al. | | |
| 2006/0180325 | A1* | 8/2006 | Stoetzer | E21B 15/04 | 172/452 |
| 2010/0319222 | A1 | 12/2010 | Lanzl et al. | | |
| 2011/0147090 | A1 | 6/2011 | Ditillo et al. | | |
| 2013/0341045 | A1 | 12/2013 | Flusche | | |
| 2014/0151078 | A1 | 6/2014 | Bettini et al. | | |

(Continued)

*Primary Examiner* — Kipp C Wallace
(74) *Attorney, Agent, or Firm* — Phelps Dunbar, LLP; R. Andrew Patty, II

(57) ABSTRACT

One or more apparatuses are described for drilling, and related methods. The apparatus can include a mast articulation mechanism supported by a base structure, an elongated mast, and a mast actuator.

12 Claims, 5 Drawing Sheets

(56) References Cited

U.S. PATENT DOCUMENTS

| | | | | |
|---|---|---|---|---|
| 2018/0066483 | A1 | 3/2018 | Zanichelli | |
| 2018/0334856 | A1* | 11/2018 | Fontana | E02D 7/00 |
| 2021/0110684 | A1* | 4/2021 | Bauer | H04N 5/265 |
| 2021/0180411 | A1* | 6/2021 | Beretta | E21B 7/02 |

* cited by examiner

DRILLING APPARATUS AND RELATED METHOD

CROSS-REFERENCE TO RELATED APPLICATIONS

This application is a continuation of U.S. patent application Ser. No. 17/196,454, filed Mar. 9, 2021, which claims benefit of U.S. Provisional Application No. 62/987,076, filed on Mar. 9, 2020. The above patent applications are incorporated here by reference in their entirety to provide continuity of the disclosure.

TECHNICAL FIELD

The present disclosure relates to apparatuses for drilling and related methods, and more specifically apparatuses for drilling a borehole that employ a mast structure and related methods.

BACKGROUND

This section introduces information that may be related to or provide context for some aspects of the techniques described herein and/or claimed below. This information is background facilitating a better understanding of that which is disclosed herein. Such background may include a discussion of "related" art. That such art is related in no way implies that it is also "prior" art. The related art may or may not be prior art. The discussion is to be read in this light, and not as admissions of prior art.

Drill rigs generally have two primary configurations: (1) short mast configuration, and (2) long mast configuration. A short mast configuration is configured to operate in an area constrained by the amount of available head room and may have a mast height of less than or equal to about 35 feet, for example, a height in the range of from about 25 feet to about 30 feet. A long mast configuration is configured to operate in an area that is not constrained or significantly constrained by the amount of available head room and may have a mast height greater than about 35 feet, for example, a height in the range of from about 40 feet to about 60 feet.

Typically, the same geometric design is used for the mast positioning structure on both drill rig configurations, which can cause several design tradeoffs such as necessitating use of a multitude of detachable or foldable elements for one or more of the mast, rotary, Kelly bars, and header. Additionally, the length and number of Kelly bar elements is restricted by certain requirements for transport on roads and highways in the U.S.

Thus, there is a need for foundation drilling rigs capable of achieving maximum drill depth (i.e., ground penetration) while minimizing the height of the apparatus that is used in areas with overhead obstructions such as, for example, bridges and power lines. Further, there is a need for new and improved apparatuses for drilling and related methods that minimize or reduce the impact from the above and other limitations.

NON-LIMITING SUMMARY

In general, the present disclosure provides one or more apparatuses for drilling and related methods.

In an aspect, an apparatus for drilling is provided. The apparatus comprises (A) a mast articulation mechanism supported by a base structure; (B) an elongated mast secured to the mast articulation mechanism; and (C) a mast positioning actuator comprising a mast actuator supported by a removable mounting element, wherein (i) the mast positioning actuator is secured to the mast articulation mechanism and the elongated mast so as to permit pivoting of the elongated mast between a horizontal position relative to a longitudinal axis of the base structure and a vertical position relative to the longitudinal axis of the base structure; and (ii) the removable mounting element enables repositioning of the mast actuator so as to change the articulation direction of the elongated mast in the travel position. In some implementations, the apparatus is a drilling rig.

One or more aspects include the apparatus of the preceding paragraph in which the elongated mast has a height of less than or equal to about 35 feet.

One or more aspects include the apparatus of any preceding paragraph, wherein when the removable mounting element is removed from the apparatus and the mast articulation mechanism is connected to the mast positioning actuator, the elongated mast has a height greater than about 35 feet, for example, in some implementations, the elongated mast has a height in the range of from about 40 feet to about 60 feet.

One or more aspects include the apparatus of any preceding paragraph in which the apparatus further comprises a tension element. In some implementations, the tension element is positioned across a rear portion of the apparatus and affixed to a counterweight support structure and the base structure.

One or more aspects include the apparatus of any preceding paragraph in which the apparatus further comprises one or more Kelly elements that pass through a rotary passage and one or more Kelly elements that do not pass though the rotary passage.

One or more aspects include the apparatus of any preceding paragraph in which the mast comprises a first angled rotational joint.

One or more aspects include the apparatus of the preceding paragraph in which the mast comprises a second angled rotational joint aligned with the first angled rotational joint.

In still another aspect, a method for drilling is provided. The method comprises (A) drilling a borehole using the apparatus according to any preceding paragraph.

In yet another aspect, a method for converting a mast configuration of a drill rig is provided. The method comprises (A) providing an apparatus as disclosed herein wherein the elongated mast has a short mast configuration; (B) removing the removable mounting element from the apparatus; (C) connecting the mast articulation mechanism to the mast positioning actuator; and (D) providing the elongated mast with a long mast configuration.

While multiple embodiments are disclosed, still other embodiments will become apparent to those skilled in the art from the following detailed description. As will be apparent, certain embodiments, as disclosed herein, are capable of modifications in various obvious aspects, all without departing from the spirit and scope of the claims as presented herein. Accordingly, the drawings and detailed description are to be regarded as illustrative in nature and not restrictive.

BRIEF DESCRIPTION OF THE DRAWINGS

For a detailed description of the preferred embodiments of the disclosed embodiments, reference will now be made to the accompanying drawing(s) in which.

Figure 1:
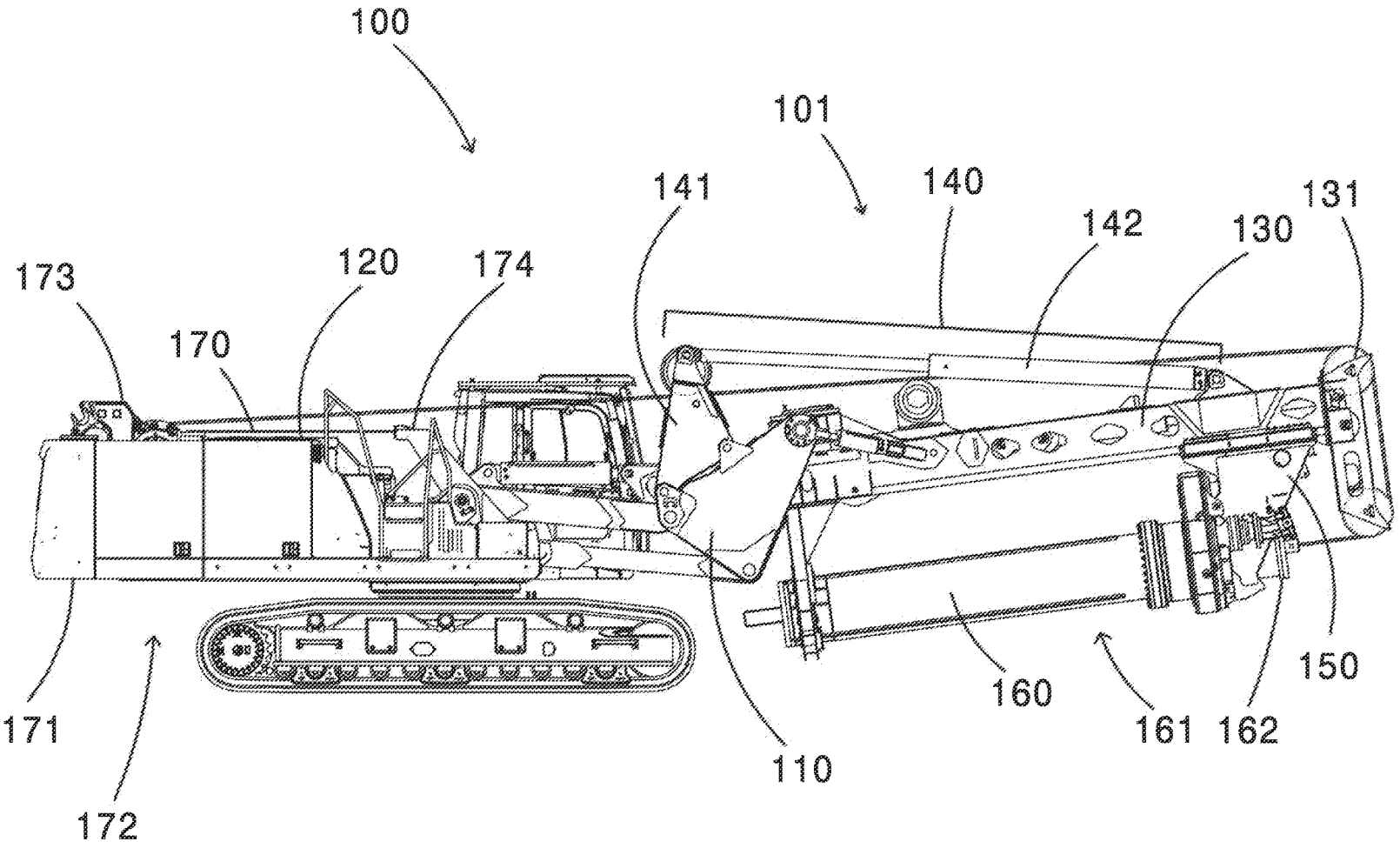
FIG. 1 illustrates a side view of an apparatus for drilling in accordance with certain aspects of the subject matter described herein.

While the claimed subject matter is susceptible to various modifications and alternative forms, the drawing(s) illustrate specific embodiments herein described in detail by way of example. It should be understood, however, that the description herein of specific embodiments is not intended to limit the claimed subject matter to the particular forms disclosed, but on the contrary, the intention is to cover all modifications, equivalents, and alternatives falling within the spirit and scope as defined by the appended claims.

Definitions

To more clearly define the terms used in this disclosure, the following definitions are provided. Unless otherwise indicated, the following definitions are applicable to this disclosure. To the extent that any definition or usage provided by any document incorporated here by reference conflicts with the definition or usage provided herein, the definition or usage provided in this disclosure controls.

In this disclosure, features of the subject matter are described such that, within particular aspects, a combination of different features can be envisioned. For each and every aspect and each and every feature disclosed herein, all combinations that do not detrimentally affect the designs, apparatuses, systems, or methods described herein are contemplated with or without explicit description of the particular combination. Additionally, unless explicitly recited otherwise, any aspect or feature disclosed herein can be combined to describe inventive designs, apparatuses, systems, processes, or methods consistent with the present disclosure.

In this disclosure, while apparatuses and methods are often described in terms of "comprising" various components or steps, the apparatuses and methods can also "consist essentially of" or "consist of" the various components or steps, unless stated otherwise. For example, an apparatus for drilling consistent with aspects of the disclosed subject matter can comprise; alternatively, can consist essentially of; or alternatively, can consist of the various components, unless stated otherwise. Similarly, a method for drilling consistent with aspects of the disclosed subject matter can comprise; alternatively, can consist essentially of; or alternatively, can consist of the various steps, unless stated otherwise. For example, a method consistent with aspects of the disclosed subject matter can comprise; alternatively, can consist essentially of; or alternatively, can consist of; the indicated steps thereof.

The terms "a," "an," and "the" are intended to include plural alternatives, e.g., at least one, one or more, and one or more than one, unless otherwise specified.

The term "about" means that amounts, sizes, formulations, parameters, and other quantities and characteristics are not and need not be exact, but may be approximate including being larger or smaller, as desired, reflecting tolerances, conversion factors, rounding off, measurement errors, and the like, and other factors known to those of skill in the art. In general, an amount, size, formulation, parameter or other quantity or characteristic is "about" or "approximate" whether or not expressly stated to be such. Whether or not modified by the term "about," the claims include equivalents to the quantities.

Various numerical ranges are disclosed herein. When a range of any type is disclosed or claimed herein (e.g., "ranging from . . . ", "in the range of from . . . ", "in a range of from") the intent is to disclose or claim individually each possible number that such a range could reasonably encompass, including end points of the range as well as any sub-ranges and combinations of sub-ranges encompassed therein, unless otherwise specified. For example, the present disclosure recites that an angle is in the range of from about 160 degrees to about 180 degrees in certain aspects. By a disclosure that the angle can be in a range from about 160 degrees to about 180 degrees, the intent is to recite that the angle can be any angle within the range and, for example, can be equal to about 160 degrees, about 170 degrees, or about 180 degrees. Additionally, the angle can be within any range from about 160 degrees to about 180 degrees (for example, the angle can be in a range from about 165 degrees to about 175 degrees), and this also includes any combination of ranges between about 160 degrees to about 180 degrees. Likewise, all other ranges disclosed herein should be interpreted in a manner similar to this example.

Embodiments disclosed herein can provide the materials or components listed as suitable for satisfying a particular feature of the embodiment delimited by the term "or." For example, a particular feature of the disclosed subject matter can be disclosed as follows: Feature X can be A, B, or C. It is also contemplated that for each feature the statement can also be phrased as a listing of alternatives such that the statement "Feature X is A, alternatively B, or alternatively C" is also an embodiment of the present disclosure whether or not the statement is explicitly recited.

All publications and patents mentioned herein are incorporated herein by reference for the purpose of describing and disclosing, for example, the constructs and methodologies that are described in the publications, which can be used in connection with the presently described subject matter.

DETAILED DESCRIPTION

Illustrative aspects of the subject matter claimed below will now be disclosed. In the interest of clarity, not all features of an actual implementation are described in this specification. It will be appreciated that in the development of any such actual embodiment, numerous implementation-specific decisions must be made to achieve the developers' specific goals, such as compliance with apparatus-related, system-related and business-related constraints, which will vary from one implementation to another. Moreover, it will be appreciated that such a development effort, even if complex and time-consuming, would be a routine undertaking for those of ordinary skill in the art having the benefit of this disclosure.

The present disclosure is generally directed to one or more apparatuses for drilling, and related methods.

An apparatus for drilling 100 is provided, for example, a mobile drilling rig. The apparatus for drilling 100 comprises (A) a mast articulation mechanism 110 supported by a base structure 120, (B) an elongated mast 130 secured to the mast articulation mechanism 110, and (C) a mast positioning actuator 140 comprising a mast actuator 142 supported by a removable mounting element 141. The mast positioning actuator 140 is secured to the mast articulation mechanism 110 and the elongated mast 130 so as to permit pivoting of the elongated mast 130 between a horizontal position relative to a longitudinal axis $L_1$ of the base structure 120 and a vertical position relative to the longitudinal axis $L_1$ of the base structure 120.

The removable mounting element 141 enables repositioning of the mast actuator 142 so as to articulate the elongated mast 130. In an aspect, the geometry of the various mounting locations of the removable mounting element 141 allows for the mast actuator 142 to be precisely located so as to either cause the elongated mast 130 to boom forward to travel position (see, e.g., FIG. 1), or when removed, to allow the mast actuator 142 to pin to the same or similar location the removable mounting element 141 previously occupied, allowing the elongated mast 130 to boom backwards to the travel position (see, e.g., FIG. 3). In some implementations, the removable mounting element 141 may be generally triangular in shape (see, e.g., FIG. 1) and mounted to the mast positioning actuator 140 and mast articulation mechanism 110.

In some implementations, the elongated mast 130 may comprise additional elements depending on the desired application for the apparatus 100. For example, when the apparatus 100 is used for drilling a borehole, the elongated mast 130 comprises a header 131, rotary 150, and short mast Kelly bar set 161. Additionally, the apparatus 100 may comprise a ground traveling mechanism to permit propulsion of the apparatus 100 on a ground surface. In some implementations, the ground traveling mechanism comprises one or more crawler track assemblies (e.g., apparatus 100 mounted to a tractor or excavator) or wheels that are coupled to the base structure 120.

Figure 2:
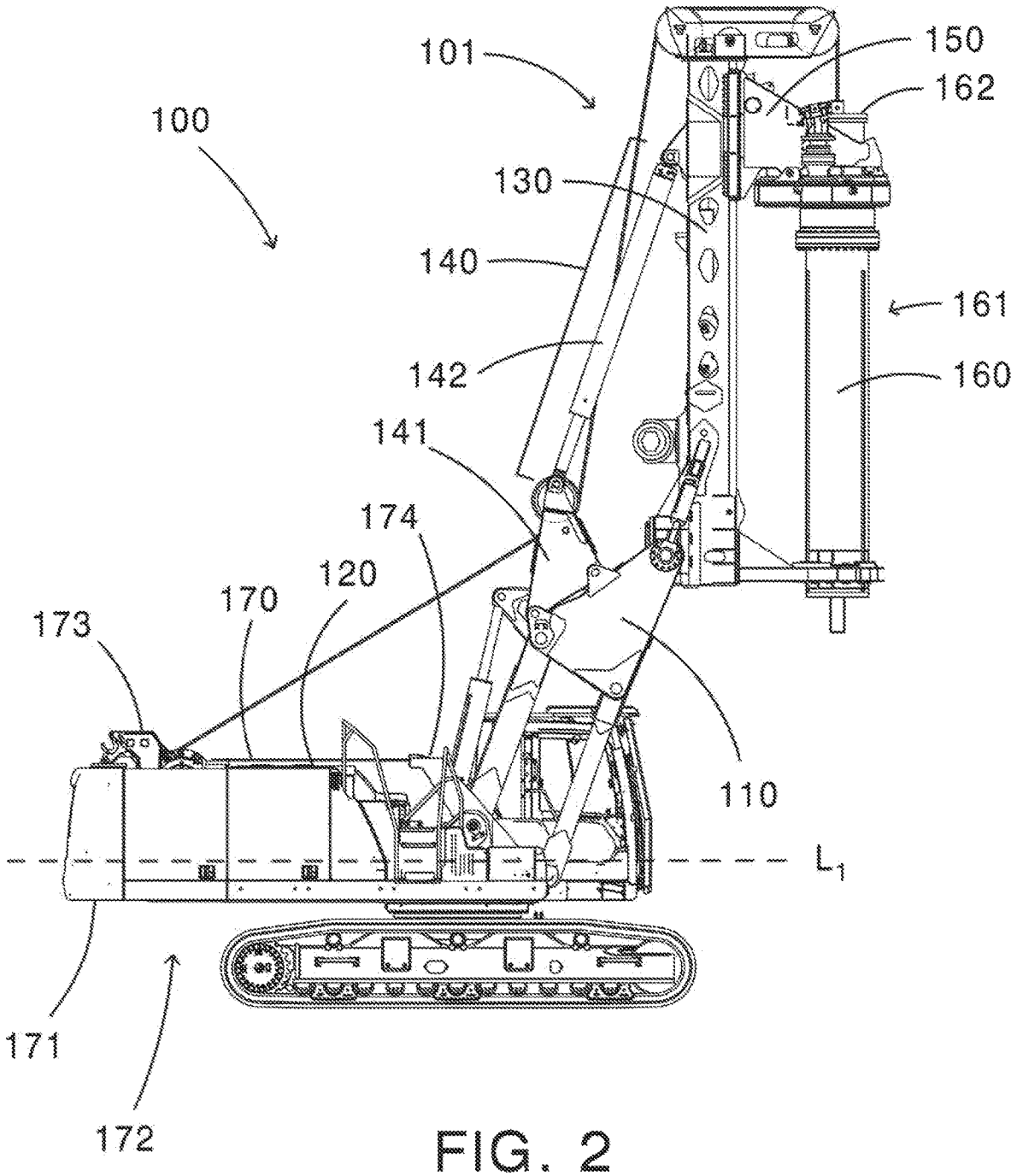
FIG. 2 illustrates a side view of the apparatus of FIG. 1.

FIG. 1 and FIG. 2 show an apparatus 100 having a short mast configuration 101. FIG. 1 depicts an apparatus 100 with the elongated mast 130 stowed in a "boom forward" travel position, which is about 160 to 180 degrees from the longitudinal axis $L_1$ of the base structure 120 (i.e., substantially parallel to the ground) where the elongated mast 130 is not stowed above the base structure 120 and the mast articulation mechanism 110, but instead the elongated mast 130 hangs in front of the base structure 120 and the mast articulation mechanism 110. FIG. 2 depicts the apparatus 100 of FIG. 1 in which the elongated mast 130 is in a vertical position, relative to the longitudinal axis $L_1$ of the base structure 120, which is typically the position used for drilling a borehole. The apparatus 100 comprises a mast articulation mechanism 110 attached to the elongated mast 130, mast positioning actuator 140, removable mounting element 141 and mast actuator 142. When the mast positioning actuator 140 contracts, the apparatus 100 moves the elongated mast 130 from the "boom forward" travel position (see, e.g., FIG. 1) into a vertical position that is substantially orthogonal to the longitudinal axis $L_1$ of the base structure 120 (see, e.g., FIG. 2).

Figure 3:
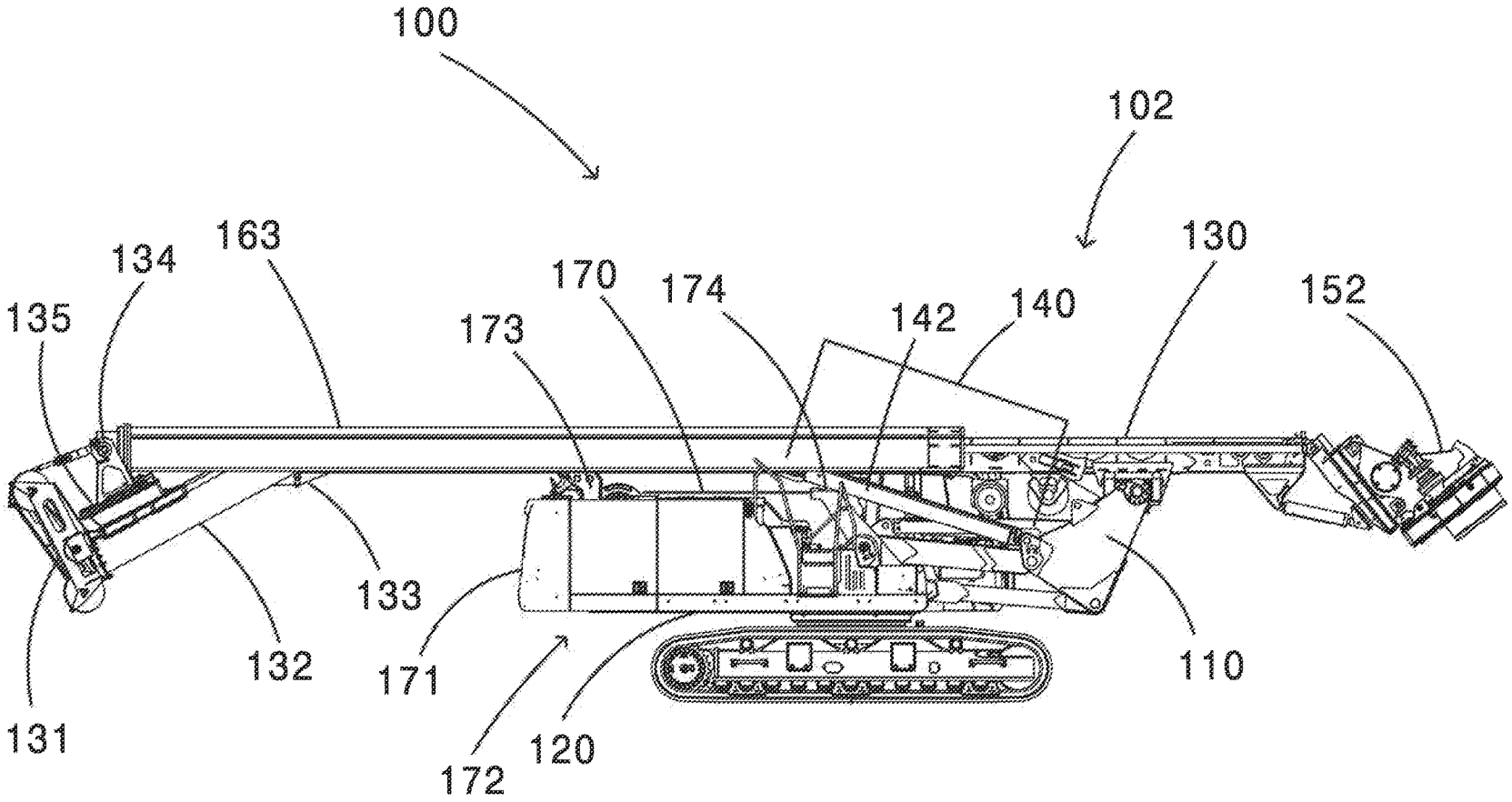
FIG. 3 illustrates a side view of an apparatus for drilling in accordance with certain aspects of the subject matter described herein.
Figure 4:
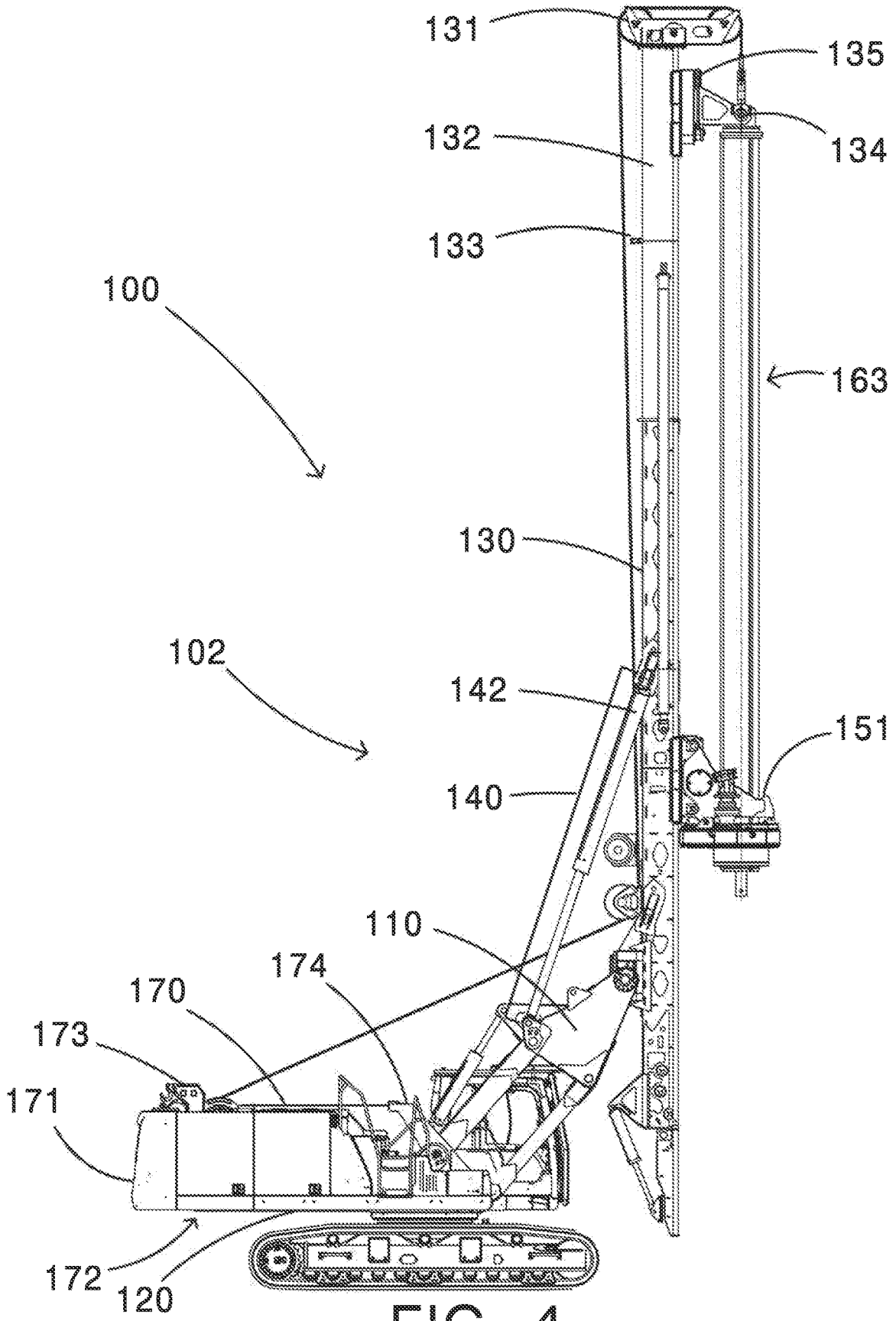
FIG. 4 illustrates a side view of the apparatus of FIG. 3.
Figure 5:
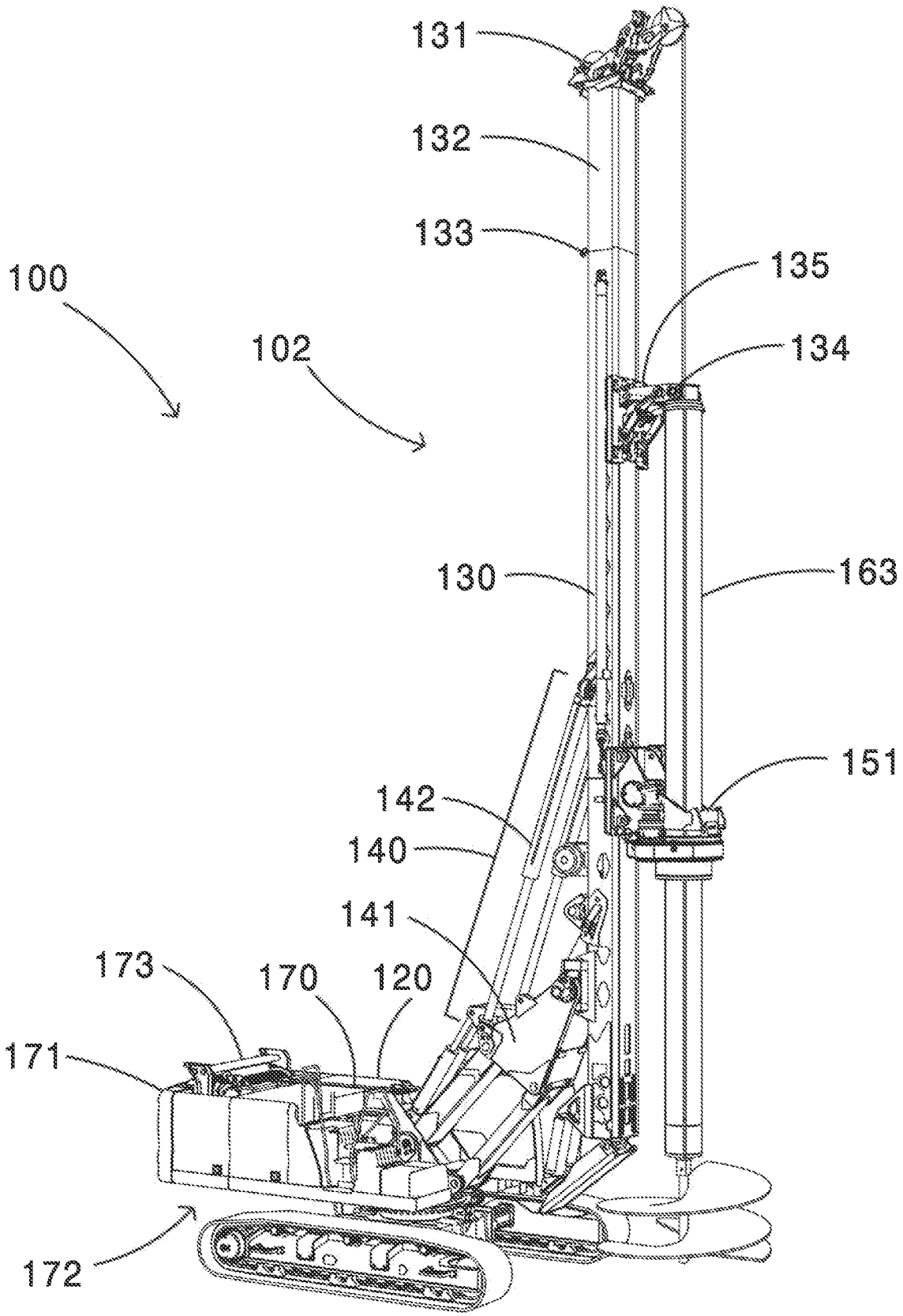
FIG. 5 illustrates a perspective of the apparatus of FIG. 3.

The apparatus 100 with the overboom short mast configuration (see., e.g., FIG. 1 and FIG. 2), provides several advantages over currently known designs. For example, the apparatus 100 does not require detachment or folding of elements that are typically detached or removed prior to transport of the apparatus 100 on a road (e.g., the mast 130, Kelly bar set 161, rotary 150, and/or header 131) to meet certain travel dimensions required by current state and federal regulations thereby making travel preparations more efficient while avoiding design tradeoffs that may compromise the strength and/or stability of the apparatus 100. Further, the apparatus 100 with the short mast configuration permits positioning of the Kelly bar set 161 below the elongated mast 130 in the "boom forward" travel position, thereby allowing for the rotary drive 150 to be in a top drive rotary configuration that allows the top of the outermost of the outer Kelly bars 160 to attach directly to the rotary drive 150 thereby creating a rigid connection rather than a sliding connection as is typical in currently known designs. Additionally, the apparatus with the short mast configuration and the top drive rotary arrangement allows for an improved Kelly arrangement comprising longer Kelly elements 162 that pass through a passage of the rotary drive 150 and additional outer Kelly elements 160 that do not pass through a passage of the rotary drive. Such an improved Kelly arrangement represents an improvement in drilling depth capability over currently known designs that generally do not permit additional kellys 160 to be added to the Kelly set 161 below the rotary drive 150. In FIGS. 3-5, the reference numeral 151 denotes that the rotary 150 is in a standard position for drilling operations, and the reference numeral 152 denotes that the rotary 150 is in a long mast travel position.

As shown in FIGS. 3-5, the removable mounting element 141 permits the apparatus 100 to achieve both short mast 101 and long mast configurations 102 using the same base structure 120 and mast articulation mechanism 110. For example, as shown in FIG. 3 and FIG. 4, to achieve a long mast configuration, the removable mounting element 141 may be removed and the mast positioning actuators 140 are reattached to a lower pin point of the mast articulation mechanism 110, which allow the elongated mast 130 to travel from the vertical drilling position (see, e.g., FIG. 4) backwards to a traditional mast and Kelly stowage position above the base structure 120 (see, e.g., FIG. 3). In this manner, the apparatus 100 described herein is capable of articulating both forward and backward from the vertical position.

Additionally, the apparatus 100 described herein permits use of the same drill rig in deeper applications as that used in shallower applications by substituting the short elongated mast 101 and short mast Kelly bar set 161 for a long elongated mast 102 (or extension of the short mast) and long mast Kelly bar set 163, as opposed to existing designs that necessitate use of a multitude of detachable or foldable elements for one or more of the elongated mast 130, rotary 150, Kelly bars, and header 131 with the same base and mast articulation mechanism 110 for the long and short mast configurations.

Thus, the disclosed subject matter provides an apparatus 100 capable of operating in an area with low headroom (i.e., an area necessitating a short mast configuration, which is generally considered a mast having a height of less than about 35 feet in height and typically a height in the range of from about 25 feet to 30 feet). The disclosed subject matter also provides an apparatus 100 with a short mast configuration capable of achieving greater drill depths (e.g., greater than about 70 feet and up to about 120 feet) than currently known drill rigs in the art, while also being convertible to operate in area requiring a long mast configuration, which is generally considered a mast having a height of greater than about 35 feet and typically a height in the range of from about 40 feet to about 60 feet, and capable of achieving drill depths of greater than about 120 feet.

As shown in FIGS. 1-5, the apparatus 100 may further comprise a counterweight load strap 170. With the overboom short mast configuration stowed in front of the base structure 120 of the apparatus 100 and mast articulation mechanism 110, and with full reach drilling positions that are achievable with the apparatus, additional counterweight moment may be needed to maintain proper balance of the apparatus 100. In currently known designs, increases in counterweight moment are typically limited by the strength of the design of the rear structure 172 of the base structure 120. To increase the moment effect of the counterweight 171, the mass and/or the lever arm of the counterweight must be increased, which can push the rear structure 172 of the base structure 120 beyond the design limits requiring additional design enhancements to the apparatus 100 to properly carry the additional loads. In the disclosed subject matter, such a load carrying enhancement may be achieved by adding a tension element 170 (e.g., counterweight load strap) across the top of the rear portion of the apparatus that affixes the counterweight support structure 173 to the middle structure 174 of the base structure 120, which effectively increases the section modulus and stiffness of the existing rear structural portion 172 of the apparatus thereby increasing the counterweight load capacity of the apparatus 100 with a minimal addition of weight and cost. Currently known designs achieve this increased section modulus by welding significant structural elements to the rear structure of the base 172 with the undesirable effects of reducing swing clearance between the base machine and the track supports, increasing weight, and cost.

As shown in FIG. 3, the long mast stowage position can be constrained by the overall travel height of the apparatus 100. Therefore, it is preferable to minimize the travel height of the apparatus 100 to allow for easier transport with fewer permits and specialty routing due to overhead height restrictions. In the boom back position, the long mast set of Kelly bars 163 are positioned above the elongated mast 130 and increase travel height beyond acceptable levels. To achieve travel heights in compliance with state and federal travel regulations, currently known designs must either remove the Kelly bars for transport and/or pivot/fold the elongated mast 130 in some manner as to lower the travel height. But, removal of the Kelly bars is not desirable because of cost and time increases. In the long mast configuration of the apparatus 100, a folding mast structure may be used to pivot the header 131, crowd sled 135, long mast Kelly bars 163 and upper mast portion 132 about a mast rotational joint 133 so as to lower the structures while keeping the Kelly bars 163 attached to the apparatus 100. Such a long mast configuration permits the Kelly bars 163 to be positioned directly above the elongated mast 130 in a parallel fashion (see, e.g., FIG. 3). The mast rotational joint 133 in an axis orientation aligned with the back of the mast structure allows the elements to fold directly down towards the ground, but this existing method leaves the Kelly bars still positioned directly above the elongated mast 130. In the improved design, as shown in FIG. 3 and FIG. 4, the mast rotational joint 133 may comprise an angled pivoting axis (or two rotational joints combining to achieve same angled rotational effect) to the elongated mast 130 and another similarly oriented rotational joint 134 (or combination of joints) between the kelly bars and crowd sled 135 that allow certain elements (e.g., upper mast portion 132, crowd sled 135, header 131, and Kelly bar set 163) to pivot both down towards the ground as in existing art but also off to one side of the elongated mast 130, thus positioning the Kelly bars alongside the elongated mast 130 for travel and further reducing the travel height of the apparatus 100.

Although the apparatus 100 disclosed herein is described in relation to drilling, it should be appreciated that one or more of the apparatuses may be employed in other applications such as, for example, heavy equipment employed in foundation construction.

A method for drilling is also provided by the present disclosure. The method comprises drilling a borehole in the ground using one or more of the apparatuses described in this document.

The subject matter is described above with reference to numerous aspects and specific examples. Many variations will suggest themselves to those skilled in the art in light of the above detailed description. All such obvious variations are within the full intended scope of the appended claims. Other aspects of the subject matter disclosed herein can include, but are not limited to, the following (aspects are described as "comprising" but, alternatively, can "consist essentially of", or "consist of"):

Aspect 1. An apparatus comprising (A) a mast articulation mechanism supported by a base structure; (B) an elongated mast secured to the mast articulation mechanism; and a mast positioning actuator comprising a mast actuator supported by a removable mounting element, wherein (i) the mast positioning actuator is secured to the mast articulation mechanism and the elongated mast so as to permit pivoting of the elongated mast between a horizontal position relative to a longitudinal axis of the base structure and a vertical position relative to the longitudinal axis of the base structure; and (ii) the removable mounting element enables repositioning of the mast actuator so as to articulate the elongated mast; and wherein the apparatus is a drilling rig.

Aspect 2. An apparatus as defined by Aspect 1, wherein the elongated mast has a height of less than or equal to about 35 feet.

Aspect 3. An apparatus as defined by Aspect 1, wherein when the removable mounting element is removed from the apparatus and the mast articulation mechanism is connected to the mast positioning actuator, the elongated mast has a height greater than about 35 feet.

Aspect 4. An apparatus as defined by Aspect 3, wherein the elongated mast has a height in the range of from about 40 feet to about 60 feet.

Aspect 5. An apparatus as defined by any of Aspects 1-4, wherein the apparatus further comprises (i) one or more Kelly elements that pass through a passage of a rotary drive secured to the elongated mast, and (ii) one or more Kelly elements that do not pass through a passage of the rotary drive.

Aspect 6. An apparatus as defined by any of Aspects 1-4, wherein the apparatus further comprises a tension element.

Aspect 7. An apparatus as defined by Aspect 6, wherein the tension element is positioned across a rear portion of the apparatus and affixed to a counterweight support structure and the base structure.

Aspect 8. An apparatus as defined by any of Aspects 1-7, wherein the mast comprises a first angled rotational joint.

Aspect 9. An apparatus as defined by any of Aspects 1-8, wherein the mast comprises a second angled rotational joint aligned with the first angled rotational joint.

Aspect 10. A method for drilling, the method comprising: (A) drilling a borehole using the apparatus according to any of Aspects 1-9.

Aspect 11. A method for converting a mast configuration of a drill rig, the method comprising: (A) providing an apparatus according to Aspects 1-2 and 5-9, wherein the elongated mast has a short mast configuration; (B) removing the removable mounting element from the apparatus; (C) connecting the mast articulation mechanism to the mast positioning actuator; and (D) providing the elongated mast with a long mast configuration.

What is claimed is:

1. A drilling rig comprising:

(A) a mast articulation mechanism supported by a base structure (B) an elongated mast secured to the mast articulation mechanism, wherein the elongated mast comprises an upper mast portion, a lower mast portion, a rotary drive, one or more Kelly elements, wherein the elongated mast is configured to pivot the one or more Kelly elements downward toward the ground and sideward relative to the lower mast portion so as to position the one or more Kelly elements alongside the lower mast portion when the elongated mast is stowed in a travel position that is substantially horizontal and substantially parallel to the longitudinal axis of the base structure; and (C) a mast actuator secured to the mast articulation mechanism and the elongated mast so as to permit pivoting of the elongated mast between the travel position and a vertical position relative to the longitudinal axis of the base structure.

2. The apparatus of claim 1, wherein when the elongated mast is stowed in the travel position that is substantially parallel to the longitudinal axis of the base structure, the one or more Kelly elements are substantially horizontally coplanar with the lower mast portion.

3. The apparatus of claim 1, wherein the elongated mast further comprises two or more rotational joints, wherein the two or more rotational joints are configured to pivot the one or more Kelly elements downward toward the ground and sideward so as to position the one or more Kelly elements alongside the lower mast portion when the elongated mast is stowed in the travel position that is substantially parallel to the longitudinal axis of the base structure.

4. The apparatus of claim 3, wherein the two or more rotational joints comprise a first angled rotational joint and a second angled rotational joint, wherein the first angled rotational joint is aligned with the second angled rotational joint.

5. The apparatus of claim 4, wherein the upper mast portion and lower mast portion are connected by the first angled rotational joint.

6. The apparatus of claim 5, wherein the one or more Kelly elements and a crowd sled are connected by the second angled rotational joint.

7. The apparatus of claim 1, wherein the apparatus further comprises a tension element.

8. The apparatus of claim 1, wherein a tension element is positioned across a rear portion of the apparatus and affixed to a counterweight support structure and the base structure.

9. The apparatus of claim 1, wherein when the elongated mast is stowed in the travel position that is substantially parallel to the longitudinal axis of the base structure, the longitudinal axis of the one or more Kelly elements is coplanar or substantially coplanar with the longitudinal axis of the lower mast portion so as to arrange the one or more Kelly elements side by side with the lower mast portion.

10. The apparatus of claim 1, wherein the elongated mast has a height greater than about 35 feet.

11. The apparatus of claim 10, wherein the elongated mast has a height in the range of from about 40 feet to about 60 feet.

12. The apparatus of claim 1, wherein the elongated mast is configured to pivot the one or more Kelly elements, header and upper mast portion downward toward the ground and sideward so as to position the one or more Kelly elements, header and upper mast portion alongside the lower mast portion when the elongated mast is stowed in the travel position that is substantially parallel to the longitudinal axis of the base structure.

* * * * *